US007429977B2

(12) United States Patent
Edmunds

(10) Patent No.: US 7,429,977 B2
(45) Date of Patent: Sep. 30, 2008

(54) JOYSTICK CONTROLLER

(75) Inventor: Wayne Edmunds, Gwent (GB)

(73) Assignee: Penny and Giles Controls, Limited, Gwent (GB)

( * ) Notice: Subject to any disclaimer, the term of this patent is extended or adjusted under 35 U.S.C. 154(b) by 211 days.

(21) Appl. No.: 10/536,217

(22) PCT Filed: Nov. 19, 2003

(86) PCT No.: PCT/GB03/05032

§ 371 (c)(1),
(2), (4) Date: Jan. 12, 2006

(87) PCT Pub. No.: WO2004/049092

PCT Pub. Date: Jun. 10, 2004

(65) Prior Publication Data

US 2006/0125790 A1 Jun. 15, 2006

(30) Foreign Application Priority Data

Nov. 25, 2002 (GB) ..... 0227425

(51) Int. Cl.
*G09G 5/08* (2006.01)

(52) U.S. Cl. ..... 345/161; 74/471 XY

(58) Field of Classification Search ..... 338/128, 338/131; 250/221; 324/207.2; 341/20; 345/161; 74/471 XY See application file for complete search history.

(56) References Cited

U.S. PATENT DOCUMENTS

| | | | | |
|---|---|---|---|---|
| 3,296,882 | A | 1/1967 | Durand | 74/471 |
| 4,459,578 | A | 7/1984 | Sava et al. | 338/128 |
| 4,587,510 | A * | 5/1986 | Kim | 338/128 |
| 4,620,176 | A * | 10/1986 | Hayes | 338/128 |
| 5,532,476 | A * | 7/1996 | Mikan | 250/221 |
| 5,850,142 | A * | 12/1998 | Rountos et al. | 324/207.2 |
| 5,929,607 | A | 7/1999 | Rosenberg et al. | 320/166 |
| 6,078,247 | A * | 6/2000 | Shimomura | 338/131 |
| 6,307,486 | B1 * | 10/2001 | Takeda et al. | 341/20 |
| 6,353,430 | B2 * | 3/2002 | Cheng et al. | 345/161 |
| 6,538,639 | B1 * | 3/2003 | Takahashi | 345/161 |
| 6,580,418 | B1 * | 6/2003 | Grome et al. | 345/161 |

FOREIGN PATENT DOCUMENTS

| | | |
|---|---|---|
| DE | 41 23 503 A1 | 1/1992 |
| GB | 2 367 348 | 4/2002 |

* cited by examiner

*Primary Examiner*—Amare Mengistu
*Assistant Examiner*—Yuk Chow
(74) *Attorney, Agent, or Firm*—Wells St. John, P.S.

(57) ABSTRACT

A joystick controller comprises a housing (10) and a joystick (12) mounted for pivotal movement relative to the housing (10) by means of a ball (14) and socket joint (18,20). A yoke (18) resolves directional movement of the joystick (12) into a component direction. A sensor senses movement of the yoke (18) and generates an output indicative of movement of the joystick in the component direction. The socket (18,20) of the ball (14) and socket joint (18,20) is formed by the yoke (18).

23 Claims, 7 Drawing Sheets

JOYSTICK CONTROLLER

CROSS REFERENCE TO RELATED APPLICATION

This application is a 35 U.S.C. §371 of and claims priority to PCT International Application Number PCT/GB2003/005032, which was filed 19 Nov. 2003, and was published in English, which was based on GB Patent Application No. 0227425.6, which was filed 25 Nov. 2002, the teachings of which are incorporated herein by reference.

The present invention relates to joystick controllers and to methods of assembling joystick controllers.

Joystick controllers are used for a variety of applications requiring local or remote control of movement in multiple directions, such as industrial handling equipment, off-highway vehicles, cranes, closed circuit television (CCTV), leisure simulators, medical equipment and wheelchairs. In many instances these controllers are required to operate in a dirty environment and to endure harsh physical conditions.

A known joystick controller, such as the one described in WO 01/69343, has a joystick mounted in a housing of the controller. The joystick is pivotally mounted within a ball and socket type joint about a pivot point defined by the centre of the ball and socket. The socket is in fixedly mounted to the housing. For two-dimensional control, two yoke members are mounted to the housing such that movement of the joystick causes an angular displacement of the yoke members relative to the housing about respective orthogonal axes. The angular displacement of each of the yoke members is detected by a respective sensor which generates a corresponding output signal.

A problem with this type of joystick is that, for repeatable accurate control, the yokes need to be mounted on axes which intersect at the pivot point or centre. Inaccuracies in the machining and alignment of components can give rise to errors in the output signals.

Accuracy in the output signal is best achieved by the use of a potentiometer having a wiper part attached to the yoke and a stator part attached to the housing. A problem with use of potentiometers is that wear of the wiper and stator parts, or dirt entering these components, can give rise to the generation of noisy signals, thereby affecting accuracy and precise control. In these circumstances equipment may not be usable until the defective potentiometer has been repaired or replaced.

It is an aim of the present invention to provide a joystick controller which alleviates these problems. Further aims of the present invention include providing a joystick controller having a robust construction suitable for use in a harsh environment, and providing an economical and effective method of assembly of a joystick controller.

According to a first aspect the present invention there is provided a joystick controller comprising:

a housing;

a joystick mounted for pivotal movement relative to the housing by means of a ball and socket joint;

a yoke for resolving directional movement of the joystick into a component direction; and a sensor for sensing movement of the yoke and for generating an output indicative of movement of the joystick in the component direction;

wherein the socket of the ball and socket joint is formed by the yoke.

In an embodiment of the present invention the joystick is mounted for pivotal movement in two dimensions, wherein the controller includes two yokes, preferably orthogonally mounted on the housing with respect to one another for resolving directional movement of the joystick into two component directions. Two sensors, each operative for sensing movement of a respective yoke are provided for generating respective outputs indicative of movement of the joystick in each of the component directions.

It is an advantage that the yokes define the pivot centre of the joystick. In a preferred embodiment, the two yokes are a first yoke member mounted to the housing for pivotal movement about a first axis and a second yoke member mounted to the housing for pivotal movement about a second axis, the pivot centre being where the axes intersect.

A source of alignment error is thereby eliminated. There are also a reduced number of components to be manufactured and assembled, when compared with prior art joysticks, because the yokes together forming the socket.

The housing, first and second yoke members may comprise components manufactured by a die-casting process. Preferably the die-casting process is a high-accuracy pressure die-casting process.

The advantages of using die-cast components are that they provide a rugged construction, have a high dimensional accuracy and avoid the need for subsequent machining operations prior to assembly of the components.

The first yoke member may be mounted to the housing so as to mate or contact with a correspondingly profiled upper surface of a ball member, whereby the members can slidably rotate relative to one another.

The mating surface of the first yoke member is provided with a slot or opening, the joystick extending therethrough from the ball member. The slot/opening is such as to provide for relative rotation of the other yoke member.

The second yoke member may be mounted to the housing so as to mate or contact with a correspondingly profiled lower surface of the ball member for relative slidable rotation. The second yoke member is coupled to the joystick so that movement thereof is such as to pivot the second yoke about the second axis.

The coupling of the joystick to the yoke may be effected by engagement between an extension of the joystick in a slot provided in the second yoke member. The slot is aligned to allow movement of the joystick in a direction parallel to the second axis without engaging the second yoke member and for allowing the joystick to effect movement of the first yoke member.

Mounting the first and second yoke members above and below the ball member respectively ensures that the ball is snugly held between the mating socket surfaces of the yoke members. This arrangement also facilitates assembly of the joystick from one direction without having to turn the joystick over before all the moving components are assembled.

The sensors may each include a sensor element that is carried by a respective yoke member, and a stator element in fixed relationship with the housing, whereby movement of the sensor element relative to the stator element is operable for causing the sensor to produce an output signal.

Each yoke member may carry a further sensor element, a further sensor being provided for producing a further output signal in response to movement of the further sensor element. The first and/or second sensor means may be a potentiometer, the respective sensor element being a wiper of the potentiometer, a stator of the potentiometer being fixed relative to the housing. The further sensor means may be a non-contact sensor, such as a Hall effect sensor with the sensor element being a magnet. It is an advantage that, although less accurate than a potentiometer, a non-contact (e.g. Hall effect) sensor is not susceptible to the generation of noisy signals caused by wear or dirt. Thus, if the output signal from the potentiometer becomes noisy, the output from the non-contact sensor may be used instead. This allows continued operation of the joystick until such time as the defective potentiometer can be repaired or replaced, thereby reducing equipment downtime.

The joystick controller may further include processor means for detecting a predetermined level of deterioration in the output signal generated by the potentiometer, and for automatically generating the output signal by means of the non-contact sensor instead. This arrangement provides the advantage that the less accurate, but wear-resistant non-contact sensor can automatically take over when a potentiometer signal becomes too noisy.

According to a second aspect of the present invention there is provided a method of assembling a joystick controller comprising the components:

a joystick coupled at one end to a ball;

an upper yoke member having a socket portion shaped to receive the ball and having an opening through the shaped portion;

a housing adapted to support the upper yoke member such that the upper yoke member is rotatable about a first axis relative to the housing; and a clamp member, the method comprising:

a) locating the upper yoke member into the housing;

b) inserting the joystick through the opening in the upper yoke member so that the ball mates with the shaped portion of the upper yoke member; and c) securing the clamp member to the housing to hold the assembled components together while allowing the upper yoke member to rotate about the first axis in response to movement of the joystick.

The joystick controller may include a lower yoke member having a socket portion shaped to receive the ball such that the ball is free to rotate within the socket portion. The housing and the support member may be shaped to receive the lower yoke member so that the lower yoke member is free to rotate about a second axis relative to the housing. The method may further include, prior to the step of mounting the support member, the step of locating the lower yoke member into the housing.

It is an advantage that the moveable components of controller (the joystick and the yoke members) are assembled into the housing from one direction without the need to turn the joystick over before the moveable components are secured in place.

Embodiments of the invention will now be described with reference to the accompanying drawings in which.

Figure 1:
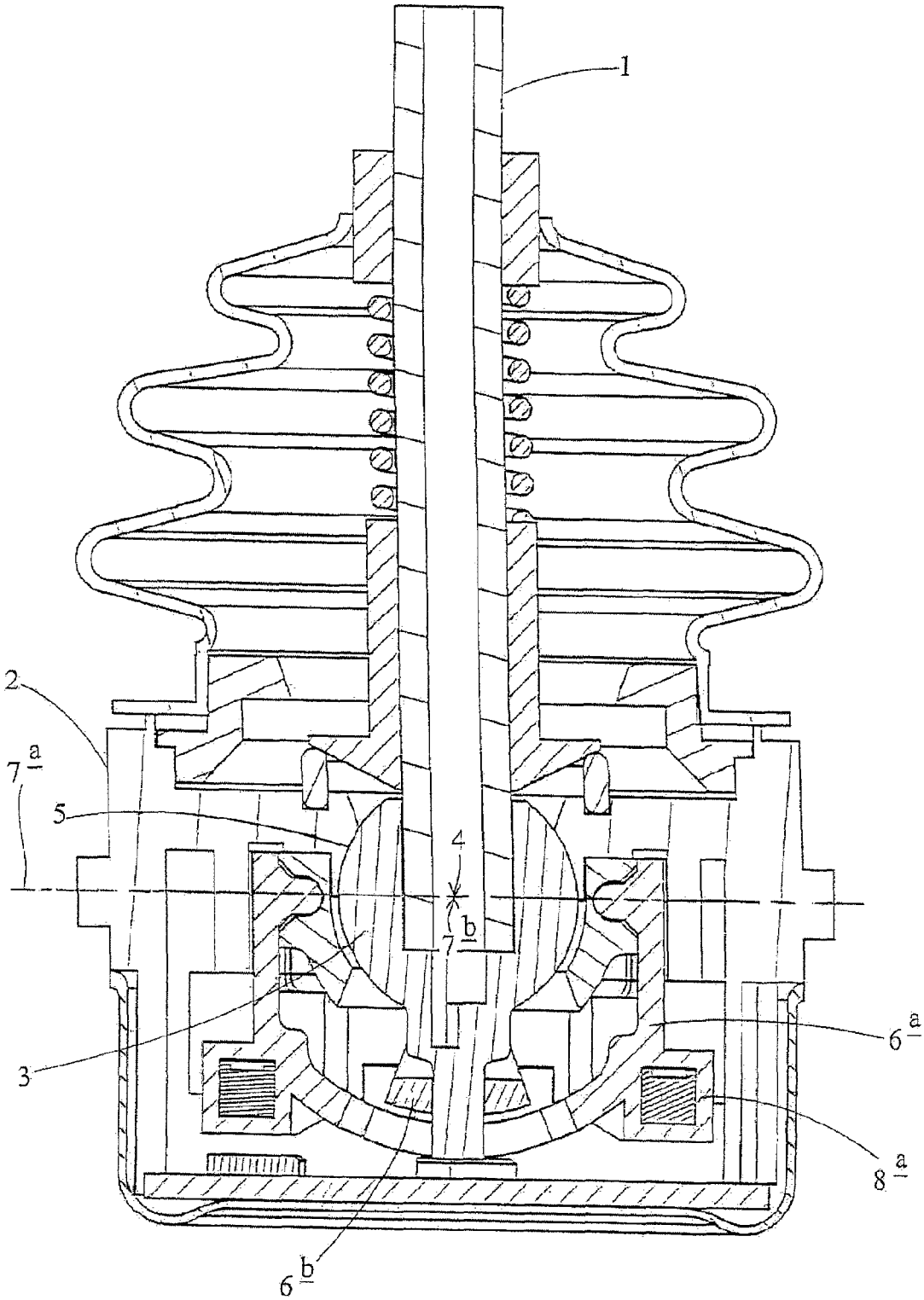
FIG 1 PRIOR ART
FIG. 1 is a sectional view of a known joystick controller.

Referring to FIG. 1, a known joystick controller has a joystick 1 mounted to a housing 2 of the controller. The joystick 1 is mounted to a ball 3 of a ball and socket joint, so as to be pivotally moveable about a pivot point 4, defined by the centre of the ball 3. The socket is defined by a part-spherical surface 5 formed by machining in the housing 2. A first yoke member 6*a* is mounted to the housing 2 such that movement of the joystick 1 causes an angular displacement of the first yoke member 6*a* relative to the housing 2 about an axis 7*a*. The angular displacement of the first yoke member 6*a* is detected by a sensor 8*a* which generates a corresponding output signal.

For two-dimensional control, a second yoke member 6*b* is mounted to the housing 2 for movement by the joystick 1 about a second axis 7*b*, orthogonal to the first axis 7*a*. A second sensor 8*b* (not shown) detects angular displacement of the second yoke member 6*b*.

For accurate and repeatable control, the first and second axes 7*a*, 7*b* about which the first and second yoke members 6*a*, 6*b* pivot, need to be aligned so that they intersect at the pivot point 4. Thus, accuracy is required in the machining and assembly of the components.

Figure 2:
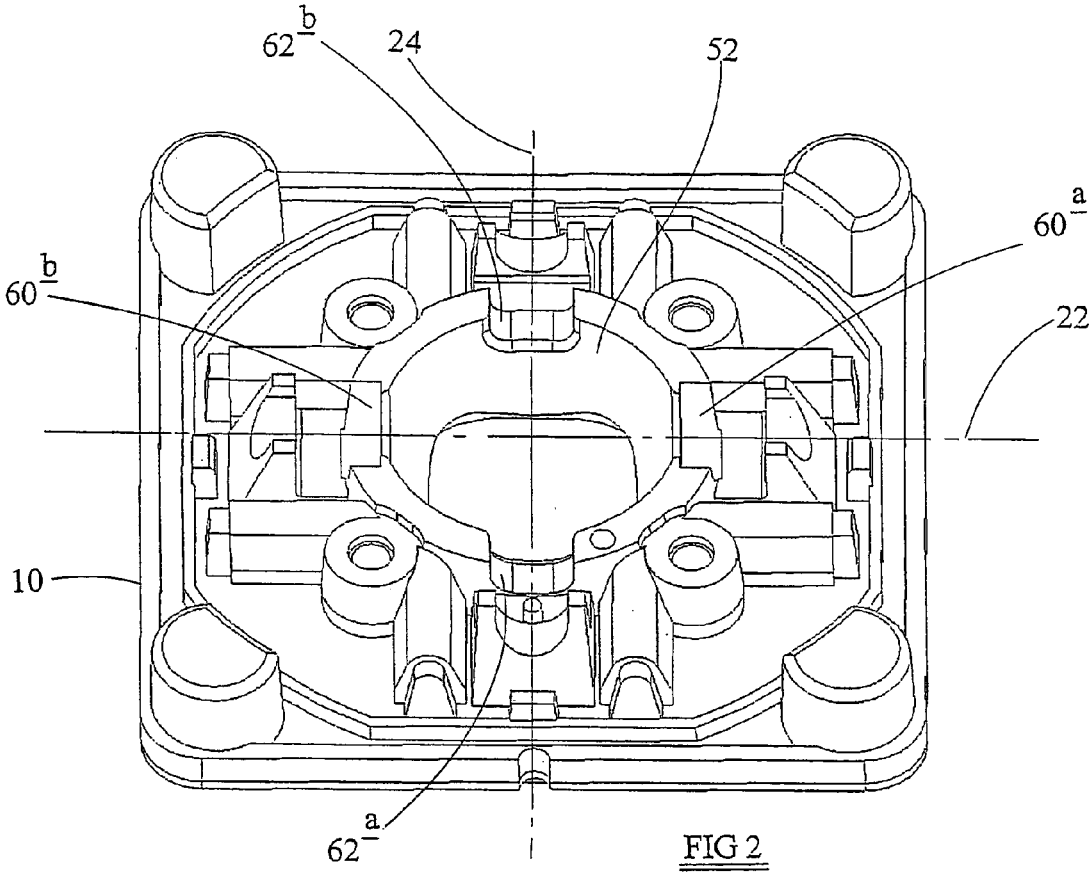
FIG. 2 shows a housing in an upside down orientation, the housing forming part of a joystick controller according to the present invention.

Referring to FIGS. 2 to 6, components of a joystick controller in accordance with the present invention are shown upside down when compared with the usual orientation in which the joystick is used. This is because the method for assembling the joystick is more readily accomplished in this orientation. As shown in FIG. 2, a housing 10 is a pressure die-cast component having cast-in features which include a gate 50 forming an opening through a part-spherical concave surface 52, a first pair of part-cylindrical grooves 60*a*, 60*b*, aligned with a first axis 22, and a second pair of part-cylindrical grooves 62*a*, 62*b*, aligned with a second axis 24.

Figure 3:
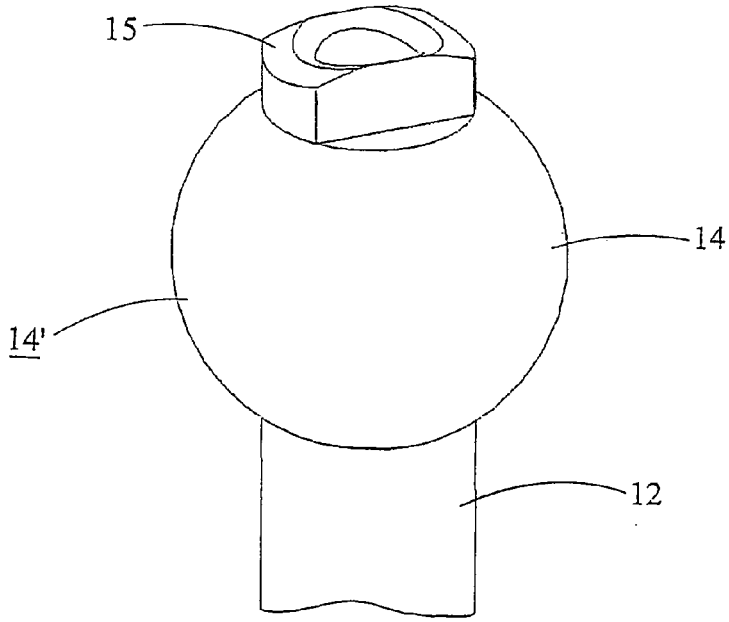
FIG. 3 shows a joystick forming part of the joystick controller of FIG. 2.

Referring to FIG. 3, a joystick has a cylindrical shaft 12 coupled at one end to a ball 14. The ball 14 has a part-spherical surface 14'. An extension 15 of the joystick extends from the ball 14 in an opposite direction to the shaft 12. The ball 14 forms a part of a ball and socket joint of the joystick controller.

Figure 4:
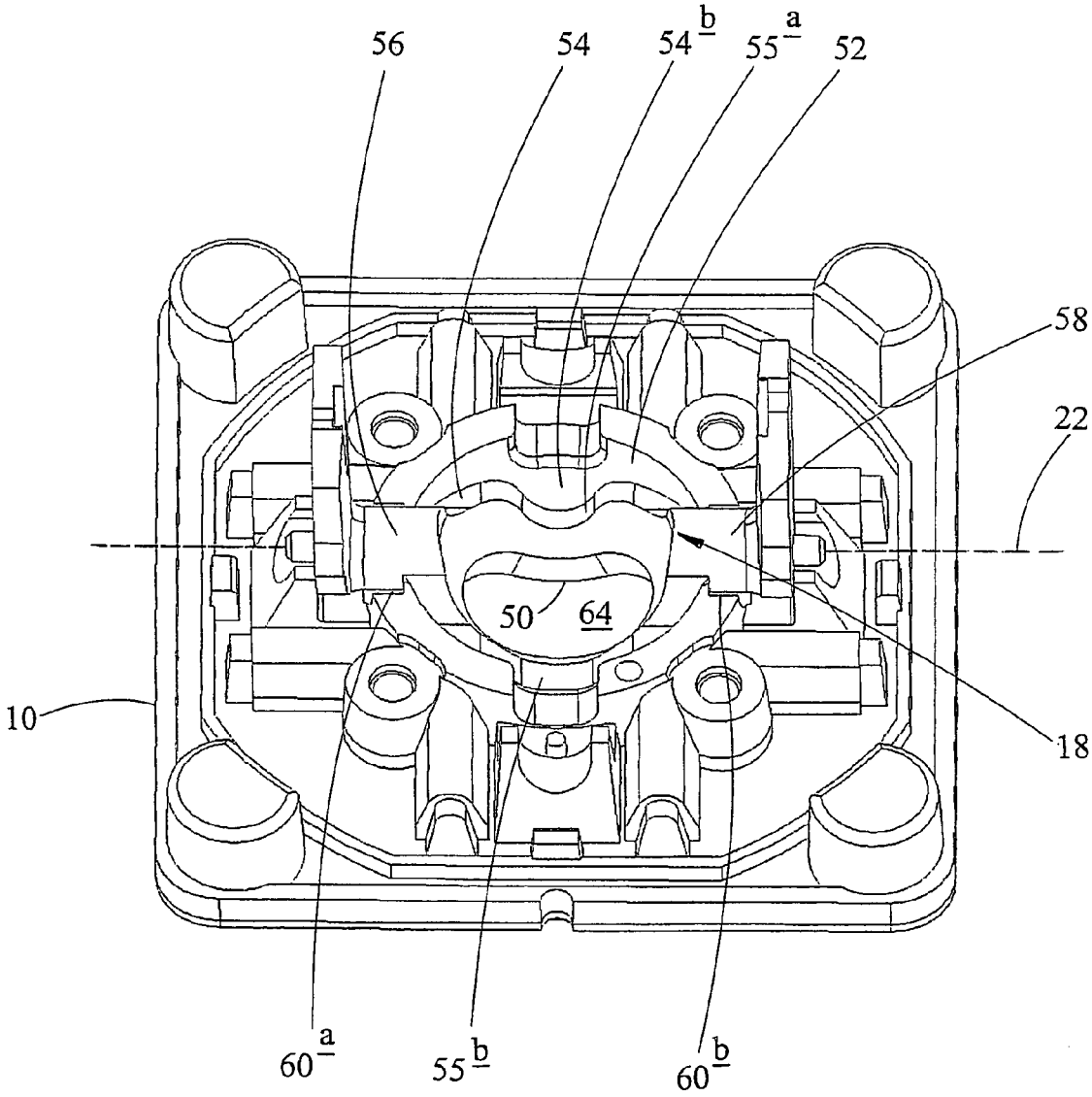
FIG. 4 shows a part assembly of the joystick controller of FIGS. 2 and 3.

FIG. 4 shows a part assembly with a first yoke member 18 located in the housing 10. The first yoke member 18 has a centre portion 54 between two axially aligned cylindrical shaft portions 56, 58. The centre portion 54 is of substantially uniform thickness between a part-spherical convex outer surface 54*a* (not visible), and a part-spherical concave inner surface 54*b*. The part-spherical outer surface 54*a* has a radius slightly smaller than the part-spherical concave surface 52 in the housing 10. The cylindrical shaft portions 56, 58 of the yoke member 18 are located in the corresponding axially aligned pair of grooves 60*a*, 60*b* formed in the housing 10, so that the first yoke member 18 is free to rotate about the first axis 22.

The part-spherical concave inner surface 54*b* of the centre portion 54 of the first yoke member 18 is of the same radius as, so as to mate with, the part-spherical convex surface 14' of the ball portion 14. A slot 64 is provided in the centre portion 54 of the first yoke member 18 has. The slot 64 has a width substantially the same size as, and a length substantially greater than the diameter of the joystick shaft 12 (shown in FIG. 3). In use, the first yoke member 18 may be urged into pivotal movement about the first axis 22 by the joystick shaft 12 bearing against the sides of the slot 64. The joystick shaft 12 is free to move parallel to the length of the slot 64 when the joystick pivots about the second axis 24.

Figure 5:
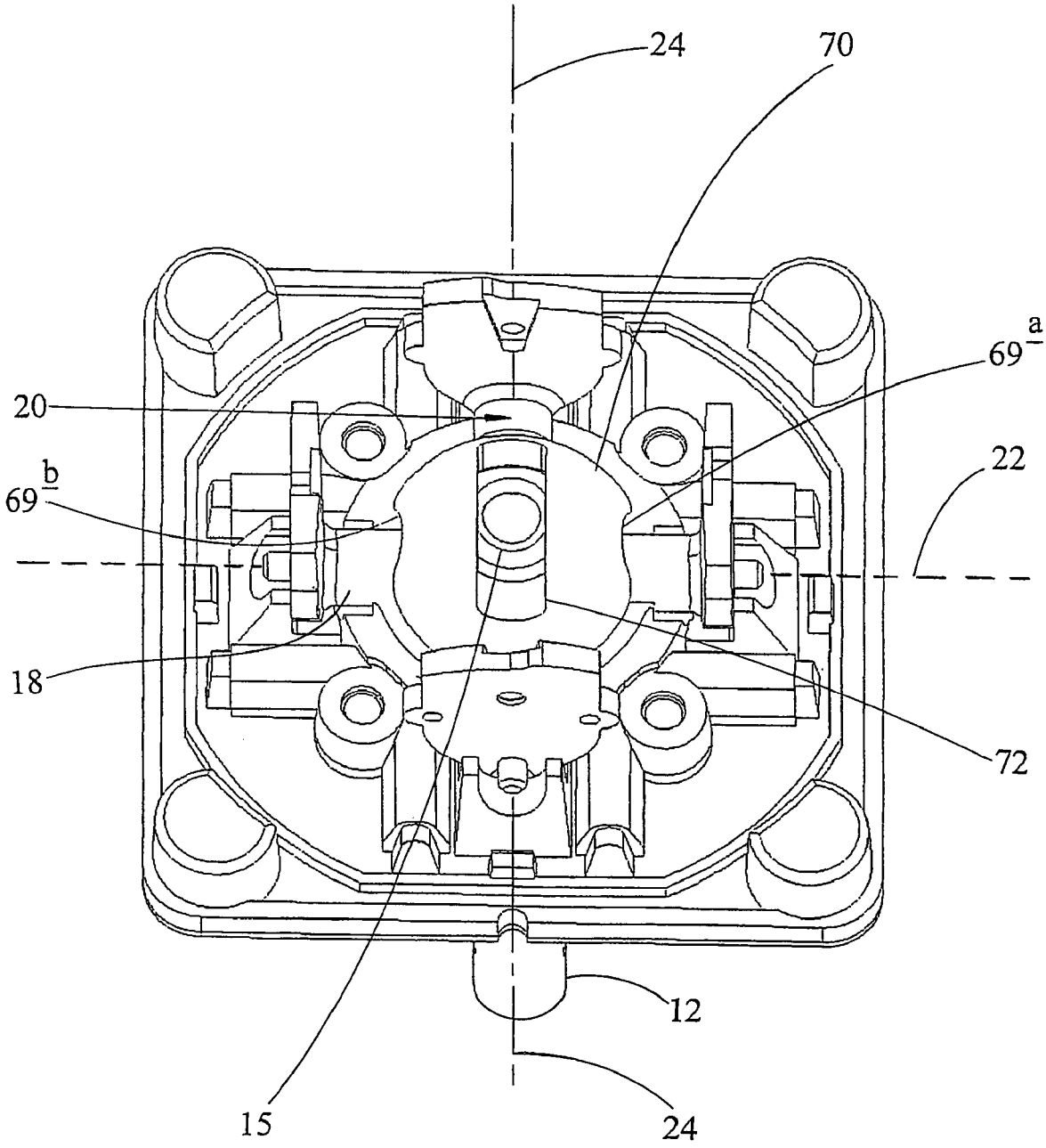
FIG. 5 shows a further part assembly of the joystick controller of FIGS. 2 to 4.

FIG. 5 shows a part assembly having the same view as FIG. 3, but with the joystick and a second yoke member 20 in place.

The second yoke member 20 is of similar construction to the first yoke member 18, except that the centre portion 70 is adapted to fit around an opposing side of the part-spherical surface 14' of the ball portion 14. The second yoke member is located in the corresponding axially aligned grooves 62*a*, 62*b* (see FIG. 1) in the housing 10 disposed at 90 degrees to the grooves 60*a*, 60*b* in which the first yoke member 18 is located. Thus the second yoke member is free to rotate about the second axis 24.

The centre portion 54 of the first yoke member 18 has an opposed pair of recesses 55*a*, 55*b* which align with the grooves 62*a*, 62*b* in which the second yoke member is located. The recesses 55*a*, 55*b* ensure that the first yoke member is free to rotate without being obstructed by the second yoke member 20. Similar recesses 69*a*, 69*b* are provided in the second yoke member to prevent obstruction by the first yoke member.

The extension 15 of the joystick extends into a corresponding slot 72 in the centre portion 70 of the second yoke member 20. In use, the second yoke member 20 may be urged into pivotal movement about the second axis 24 by the extension 15 bearing against the sides of the slot 72. The extension 15 is free to move parallel to the slot 72 when the joystick pivots about the first axis 24.

Figure 6:
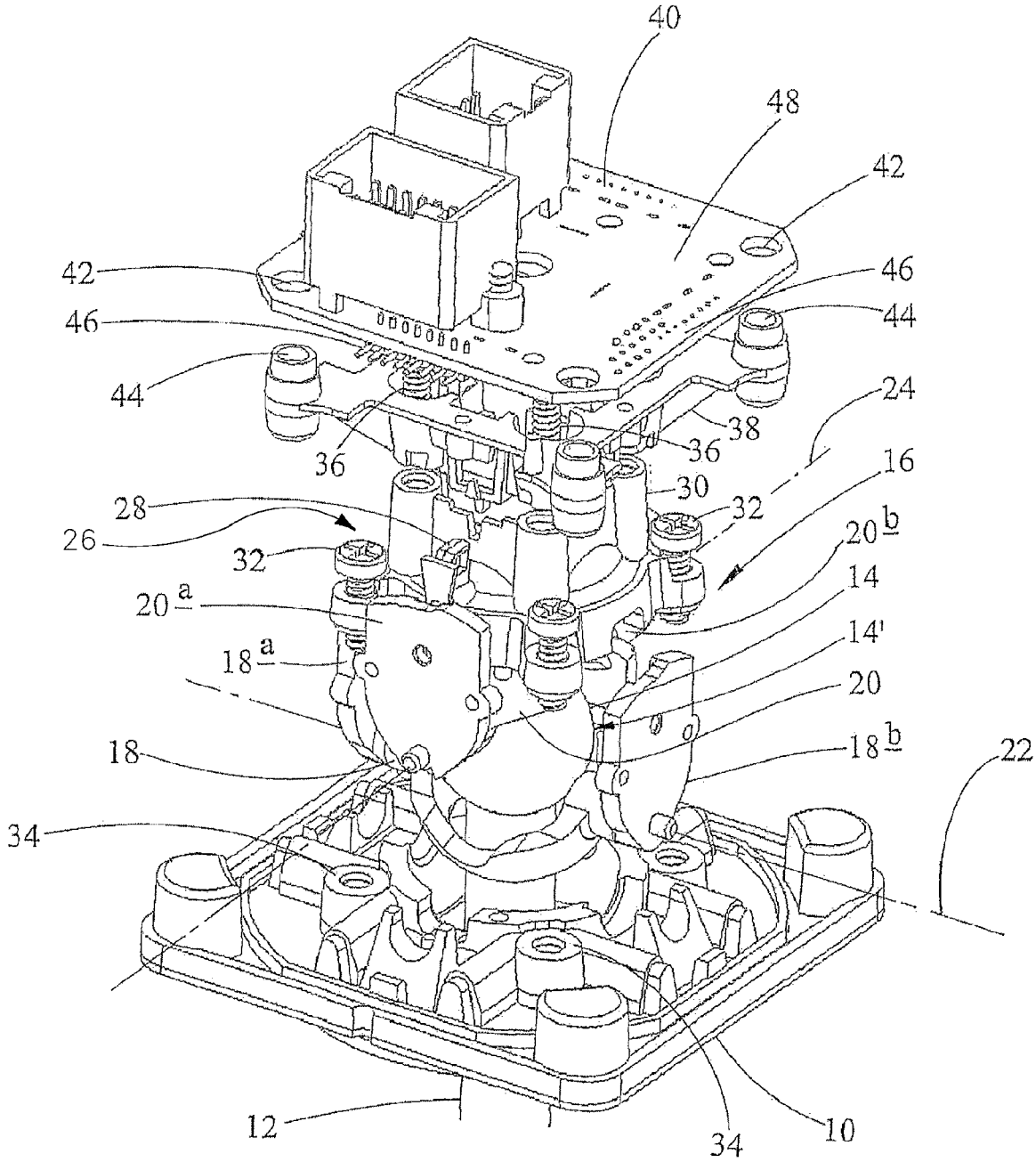
FIG. 6 shows an exploded view of an assembly of the joystick controller of FIGS. 2 to 5.

FIG. 6 shows the components of the joystick arranged in an exploded view. The first yoke member 18 is provided with an arm 18*a*, extending radially from the first axis 22. Similarly, the second yoke member has an arm 20*a*, extending radially from the second axis 24. A first sensor element 26 (not visible in FIG. 6) is provided for mounting to the arm 18*a* of the first yoke member 18 and a second sensor element 28 is provided for mounting to the arm 20*a* of the second yoke member 20. The first and second yoke members 18, 20 are each provided with a respective further arm 18*b*, 20*b*. Further sensor elements (not shown) may be provided for mounting to the further arms 18*b*, 20*b*. The sensor elements 26, 28 are moving elements of angular position sensors. These may be wipers of potentiometers, or elements of non-contact sensing devices, such as magnets for Hall effect sensors.

The joystick components further comprise a support member 30 and screws 32 for mounting the support member by engagement in corresponding threaded holes 34 in the housing 10. The support member 32 is shaped to support the moveable components when the joystick is turned over to its usual orientation, while allowing the second yoke member 20 free to pivot on the second axis 24.

A further set of screws 36 is provided for mounting a base member 38 to the support member 30. The base member 38 is shaped to receive a circuit board 40 by engagement of holes 42 in the circuit board 40 over corresponding collars 44 on the base member. The circuit board 40 has connectors 46 for connection to stator elements (not shown) of angular position sensors which detect the angular displacement of the yoke members 18, 20. The circuit board 40 is provided with electronic circuitry 48 for generating output signals based on the sensed angular positions.

Figure 7:
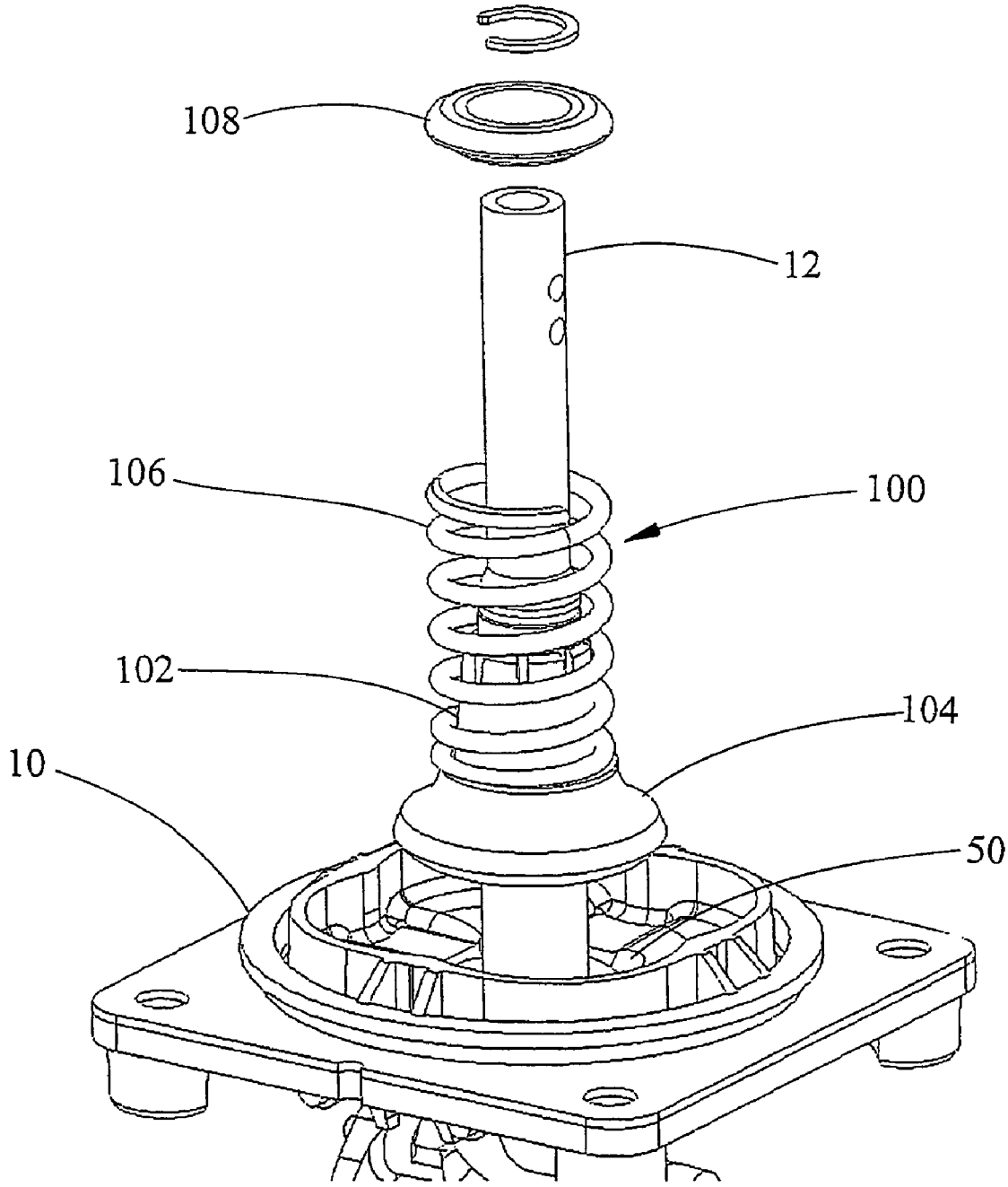
FIG. 7 is a partial view of the assembled components of FIG. 6 in an upright orientation.

Referring to FIG. 7, where the assembled joystick controller is shown in its normal operational orientation, the joystick shaft 12 extends through the gate 50 in the housing 10. The joystick shaft 12 is further provided with a centering arrangement 100 having a cone piece 102 slideably mounted on the shaft 12 and having an enlarged diameter base 104 adjacent the housing 10. A helical spring 106 surrounds the shaft 12 and abuts a stop 108 on the shaft 12 so as to bias the cone piece 102 towards the housing 10. In use, movement of the joystick shaft 12 in any direction away from the centre of the gate 50 causes the base 104 of the cone piece 102 to be urged against the biasing action of the spring 106 so that the cone piece 102 slides up the shaft 12. When the joystick shaft 12 is released, the biasing action of the spring 106 against the cone piece 102 causes the joystick 12 to return to the centre of the gate 50.

Figure 8:
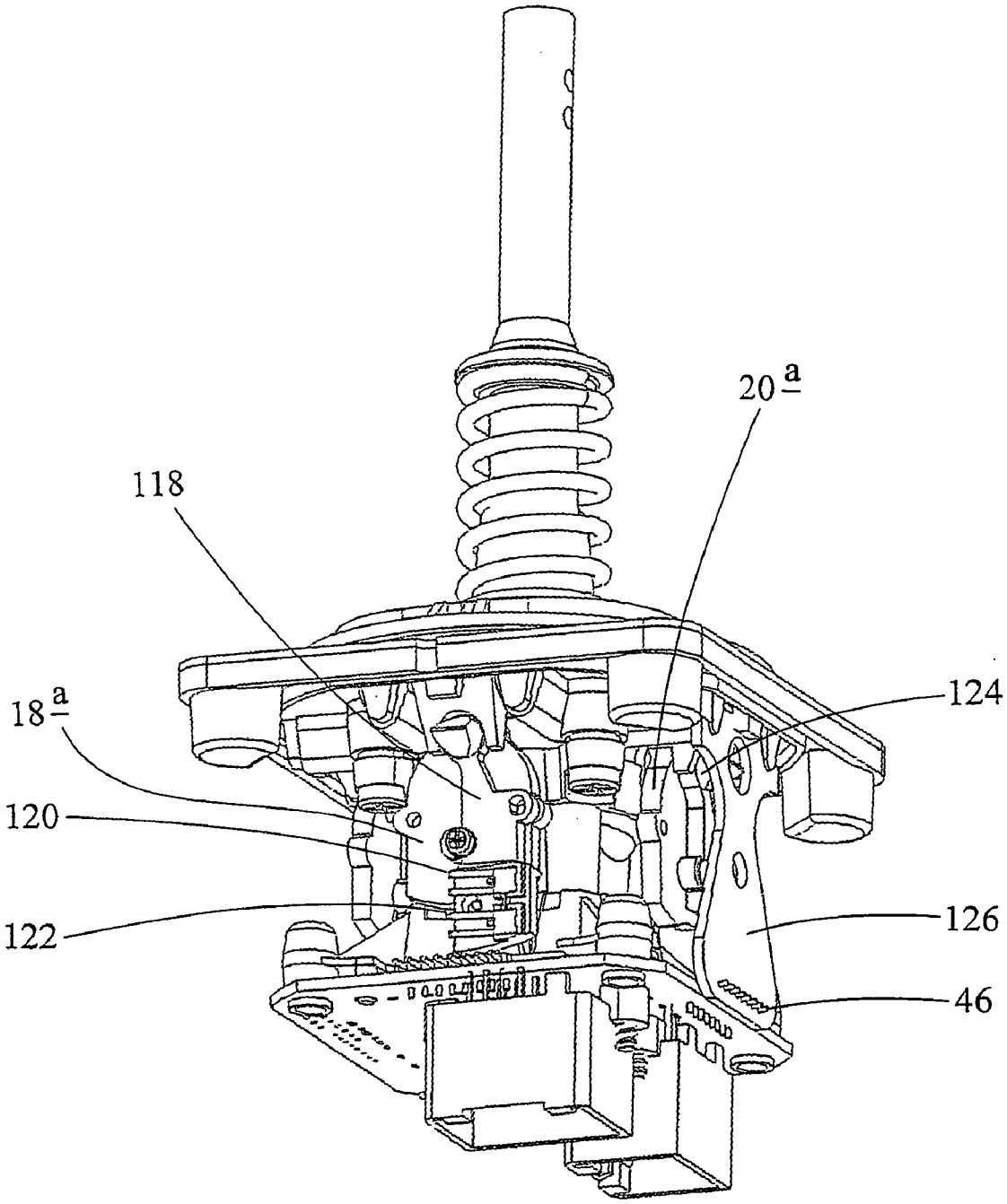
FIG. 8 is a view from underneath of the assembly of FIG. 7, including additional components.

FIG. 8 is a view from the underside of the assembled components of the joystick controller and shows the attachment of angular position sensors. Mounted on the arm 18*a* of the first yoke member 18 is a carrier 118 for a first angular position sensor element in the form of a pair of wipers 120, 22 for a potentiometer. The wipers are preferably constructed of an electrically conductive metal having good low friction characteristics. A similar carrier 124 is mounted to the arm 20*a* of the second yoke member 20 for a second angular position sensor.

The wipers 120, 122 engage a track on a stator part of the first angular position sensor potentiometer mounted to a pillar, which is not shown in FIG. 7 for clarity. Angular displacement of the first yoke member 18 about the first axis 22 is detected by movement of the wipers 120, 122 along the track so as to effect a change in the electrical resistance of the potentiometer. A similar stator part of the second angular position sensor is mounted to a similar pillar 126, shown in FIG. 8. Electrical connections to the potentiometer are made via the pins 46 on the printed circuit board 40 engaging in corresponding holes in the pillar 126.

A casing (not shown) is provided to enclose the assembly of components underneath the housing 10. By making the casing from a metallised material, such as a pressure die-cast zinc alloy, the electronic components inside the casing can be shielded from radio frequency interference.

Referring again to FIGS. 2 to 6, assembly of the joystick can be conveniently performed by the following method steps.

a) Locating the first yoke member 18 into the housing 10 as shown in FIG. 3.

b) Inserting the joystick shaft 12 through the slot 64 in the first yoke member 18 so that the ball 14 of the operating shaft 12 mates with the part-spherical inner surface 54*b* of the first yoke member 18.

c) Locating the second yoke member 20 over the ball 14 of the operating shaft 12 so that the shaft extension 15 is located in the slot 72 and the part-spherical inner surface of the second yoke member mates with the ball 14, as shown in FIG. 4.

d) Mounting the support member 30 to the housing by means of screw fasteners 32, so as to hold the assembled components together while leaving the first and second yoke members 18, 20 free to rotate about the first and second axes 22, 24 respectively.

e) Locating the base member 38 to the support member 30 by means of screws 36.

f) Mounting the printed circuit board 40 onto the collars 44 on the base member 38 and staking the collars 44 to hold the printed circuit board 40 in place.

All of the above assembly steps can be accomplished with the joystick controller mounted upside down. Once these assembly steps are complete the moving components are assembled and the joystick can be picked up or turned over to complete the remaining manufacturing steps without any risk of parts becoming dislodged or detached. This eliminates any need to temporarily hold parts together during the assembly process. No special assembly skills are required.

The invention claimed is:

1. A joystick controller comprising:

an upper housing having a concave surface with an opening therethrough;

a first yoke having a complementary outer convex surface whereby the yoke is rotatable about a first axis by sliding movement between the complementary concave and convex surfaces, the first yoke being provided with an inner part-spherical concave surface concentric with the outer surface, and a slot extending through the first yoke from the inner to the outer surfaces;

an operating shaft extending through the opening in the upper housing and the slot in the first yoke and coupled to a ball portion having a part-spherical surface complementary to the part-spherical inner concave surface of the first yoke;

a lower clamping arrangement provided with a part-spherical concave surface complementary to the part-spherical surface of the ball portion, whereby the part-spherical concave surfaces together provide a socket within which the ball portion is pivotable; and a first sensor for sensing movement of the first yoke and for generating a first output signal indicative of rotation of the first yoke about the first axis.

2. The joystick controller of claim 1, wherein the first sensor includes a sensor element that is carried by the first yoke, and a stator element in fixed relationship with the housing, whereby movement of the sensor element relative to the stator element is operable for causing the sensor to produce said first output signal.

3. The joystick controller of claim 2, wherein the first sensor is a potentiometer, the sensor element being a wiper of the potentiometer, a stator of the potentiometer being fixed relative to the housing.

4. The joystick controller of claim 2, wherein the first yoke carries a further sensor element, a further sensor being provided for producing an output signal in response to movement of the further sensor element.

5. The joystick controller of claim 4 wherein the further sensor is a non-contact sensor, such as a Hall effect sensor with the sensor element being a magnet.

6. The joystick controller of claim 4, further including processor means for detecting a predetermined level of deterioration in the output signal generated by the first sensor, and for automatically generating the output signal by means of the second sensor instead.

7. The joystick controller of claim 1 wherein at least one of the housing and the first yoke comprise components manufactured by a die-casting process.

8. The joystick controller of claim 7, wherein the die-casting process is a high-accuracy pressure die-casting process.

9. The joystick controller of claim 1, wherein the lower clamping arrangement includes a second yoke, mounted for rotation about a second axis substantially orthogonal to the first axis.

10. The joystick controller of claim 9, wherein the second yoke is coupled to the operating shaft so that movement thereof is such as to pivot the second yoke about the second axis.

11. The joystick controller of claim 10, wherein coupling of the operating shaft to the second yoke is effected by engagement between an extension of the operating shaft in a slot provided in the second yoke, the slot in the second yoke being aligned to allow movement of the joystick in a direction parallel to the second axis without engaging the second yoke and for allowing the operating shaft to effect movement of the first yoke.

12. The joystick controller of claim 9, wherein the second yoke comprises the part-spherical concave surface of the lower clamping arrangement complementary to the part-spherical surface of the ball portion.

13. The joystick controller of claim 9, wherein a second sensor is provided, operative for generating a second output signal indicative of rotation of the second yoke about the second axis.

14. The joystick controller of claim 13, wherein the second sensor includes a sensor element that is carried by the second yoke, and a stator element in fixed relationship with the housing, whereby movement of the sensor element relative to the stator element is operable for causing the second sensor to produce an output signal.

15. The joystick controller of claim 14, wherein the second sensor is a potentiometer, the sensor element being a wiper of the potentiometer, a stator of the potentiometer being fixed relative to the housing.

16. The joystick controller of claim 14, wherein the second yoke carries a further sensor element, a further sensor being provided for producing an output signal in response to movement of the further sensor element.

17. The joystick controller of claim 16, wherein the further sensor is a non-contact sensor, such as a Hall effect sensor with the sensor element being a magnet.

18. The joystick controller of claim 16, further including processor means for detecting a predetermined level of deterioration in the output signal generated by the first sensor, and for automatically generating the output signal by means of the second sensor instead.

19. The joystick controller of claim 9, wherein the second yoke is manufactured by a die-casting process.

20. The joystick controller of claim 19, wherein the die-casting process is a high-accuracy pressure die-casting process.

21. A joystick controller comprising:

a housing;

a joystick mounted for pivotal movement relative to the housing by means of a ball and socket joint;

at least one yoke for resolving directional movement of the joystick into a respective component direction;

first sensor means for sensing movement of the yoke and for generating an output indicative of movement of the joystick in the respective component direction the first sensor means comprising a sensor element that is carried by the yoke, and a stator element in fixed relationship with the housing;

second sensor means operative to provide a second output signal in response to movement of the joystick in the respective component direction the second sensor means comprising a non-contact sensor; and processor means for detecting a predetermined level of deterioration in the output signal generated by the first sensor means, and for automatically generating the output signal by means of the non-contact sensor instead.

22. A method of assembling a joystick controller comprising the components:

a joystick coupled at one end to a ball;

an upper yoke member having a socket portion shaped to receive the ball and having an opening through the shaped portion;

a housing adapted to support the upper yoke member so that the upper yoke member is rotatable about a first axis relative to the housing; and a clamp member, the method comprising:

a) locating the upper yoke member into the housing;

b) inserting the joystick through the opening in the upper yoke member so that the ball mates with the shaped portion of the upper yoke member; and c) securing the clamp member to the housing to hold the assembled components together while allowing the upper yoke member to rotate about the first axis in response to movement of the joystick.

23. The method of claim 22, wherein the joystick controller includes a lower yoke member having a socket portion shaped to receive the ball such that the ball is free to rotate within the socket portion, the housing and the support member being shaped to receive the lower yoke member so that the lower yoke member is free to rotate about a second axis relative to the housing, the method further including, prior to the step of mounting the support member, the step of locating the lower yoke member into the housing.

* * * * *